US010704115B2

(12) United States Patent
Okubo et al.

(10) Patent No.: US 10,704,115 B2
(45) Date of Patent: Jul. 7, 2020

(54) NON-ORIENTED ELECTRICAL STEEL SHEET AND METHOD FOR MANUFACTURING NON-ORIENTED ELECTRICAL STEEL SHEET

(71) Applicant: JFE STEEL CORPORATION, Chiyoda-ku, Tokyo (JP)

(72) Inventors: Tomoyuki Okubo, Tokyo (JP); Yoshihiko Oda, Tokyo (JP); Tadashi Nakanishi, Tokyo (JP)

(73) Assignee: JFE STEEL CORPORATION, Chiyoda-ku, Tokyo (JP)

( * ) Notice: Subject to any disclaimer, the term of this patent is extended or adjusted under 35 U.S.C. 154(b) by 203 days.

(21) Appl. No.: 15/520,148

(22) PCT Filed: Oct. 21, 2015

(86) PCT No.: PCT/JP2015/005313
§ 371 (c)(1),
(2) Date: Apr. 19, 2017

(87) PCT Pub. No.: WO2016/067568
PCT Pub. Date: May 6, 2016

(65) Prior Publication Data

US 2017/0314090 A1 Nov. 2, 2017

(30) Foreign Application Priority Data

Oct. 30, 2014 (JP) ..... 2014-221794

(51) Int. Cl.
*C21D 9/46* (2006.01)
*C22C 38/60* (2006.01)
(Continued)

(52) U.S. Cl.
CPC ..... *C21D 9/46* (2013.01); *C21D 6/005* (2013.01); *C21D 6/008* (2013.01); *C21D 8/005* (2013.01);
(Continued)

(58) Field of Classification Search
None
See application file for complete search history.

(56) References Cited

U.S. PATENT DOCUMENTS 9,466,411 B2 10/2016 Oda et al.
9,920,393 B2 3/2018 Zaizen et al.
(Continued)

FOREIGN PATENT DOCUMENTS

CN 1888111 A 1/2007
CN 103827333 A 5/2014
(Continued)

OTHER PUBLICATIONS

Google translation of JP 2004 277760A, Hiroshi Fujimura et al, published Oct. 7, 2004 (Year: 2004).*
(Continued)

*Primary Examiner* — Colleen P Dunn
*Assistant Examiner* — Michael J Kachmarik
(74) *Attorney, Agent, or Firm* — Kenja IP Law PC

(57) ABSTRACT

Disclosed is a non-oriented electrical steel sheet that is low in iron loss and exhibits excellent magnetic properties even when subjected to final annealing at high temperature. The non-oriented electrical steel sheet can be obtained from a steel (low-Al steel) having a chemical composition containing, in mass %, C: 0.005% or less, Si: 1.0% to 4.5%, Mn: 0.02% to 2.0%, Sol. Al: 0.001% or less, P: 0.2% or less, S+Se: 0.0010% or less, N: 0.005% or less, O: 0.005% or less, and Cu: 0.02% to 0.30%, and the balance consisting of Fe and incidental impurities.

4 Claims, 1 Drawing Sheet

(51) Int. Cl.

| | |
|---|---|
| ***C21D 8/12*** | (2006.01) |
| ***H01F 1/147*** | (2006.01) |
| ***C21D 6/00*** | (2006.01) |
| ***C21D 8/00*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/16*** | (2006.01) |

(52) U.S. Cl.

CPC ..... *C21D 8/1222* (2013.01); *C21D 8/1233* (2013.01); *C21D 8/1266* (2013.01); *C21D 8/1272* (2013.01); *C22C 38/00* (2013.01); *C22C 38/001* (2013.01); *C22C 38/002* (2013.01); *C22C 38/004* (2013.01); *C22C 38/005* (2013.01); *C22C 38/008* (2013.01); *C22C 38/02* (2013.01); *C22C 38/04* (2013.01); *C22C 38/06* (2013.01); *C22C 38/16* (2013.01); *C22C 38/60* (2013.01); *H01F 1/14775* (2013.01); *C22C 2202/02* (2013.01)

(56) References Cited

U.S. PATENT DOCUMENTS

| | | | | |
|---|---|---|---|---|
| 2003/0034092 | A1* | 2/2003 | Takashima | C22C 38/16 148/111 |
| 2007/0062611 | A1* | 3/2007 | Murakami | C21D 8/1244 148/111 |
| 2009/0202383 | A1 | 8/2009 | Tanaka et al. | |
| 2012/0009436 | A1 | 1/2012 | Arai et al. | |
| 2013/0263981 | A1* | 10/2013 | Zaizen | C21D 8/1255 148/645 |
| 2015/0059929 | A1 | 3/2015 | Zaizen et al. | |
| 2015/0136278 | A1 | 5/2015 | Nakanishi et al. | |
| 2015/0187475 | A1 | 7/2015 | Zaizen et al. | |

FOREIGN PATENT DOCUMENTS

| | | | | |
|---|---|---|---|---|
| EP | 1501951 | A1 | | 2/2005 |
| JP | H09302414 | A | | 11/1997 |
| JP | 2000017332 | A | | 1/2000 |
| JP | 2001323344 | A | | 11/2001 |
| JP | 2001323345 | A | | 11/2001 |
| JP | 2001323347 | A | | 11/2001 |
| JP | 2001323351 | A | | 11/2001 |
| JP | 2004277760 | A | * | 10/2004 |
| JP | 2004277760 | A | | 10/2004 |
| JP | 2004292829 | A | | 10/2004 |
| JP | 2004339537 | A | | 12/2004 |
| JP | 2007154271 | A | | 6/2007 |
| JP | 2007217744 | A | * | 8/2007 |
| JP | 2013010982 | A | | 1/2013 |
| JP | 2013189693 | A | | 9/2013 |
| JP | 2014037581 | A | | 2/2014 |
| JP | 2014040622 | A | | 3/2014 |
| JP | 2014173099 | A | | 9/2014 |
| KR | 1020140113739 | A | | 9/2014 |
| WO | 03095684 | A1 | | 11/2003 |
| WO | 2013137092 | A1 | | 9/2013 |

OTHER PUBLICATIONS

Google translation of JP 2007 217744A, Masaaki Kono et al, published Aug. 30, 2007 (Year: 2007).*

European Patent Office Machine translation of JP 2004 277760A, Hiroshi Fujimura et al, published Oct. 7, 2004 (Year: 2004).*

European Patent Office Machine translation of JP 2007 217744A, Masaaki Kono et al, published Aug. 30, 2007 (Year: 2007).*

Aug. 17, 2017, Extended European Search Report issued by the European Patent Office in the corresponding European Patent Application No. 15854201.9.

Jul. 18, 2017, Decision of Refusal issued by the Japan Patent Office in the corresponding Japanese Patent Application No. 2016-514793, with English language Concise Statement of Relevance.

Apr. 2, 2018, Office Action issued by the State Intellectual Property Office in the corresponding Chinese Patent Application No. 201580057710.0 with English language Search Report.

Jan. 12, 2016, International Search Report issued in the International Patent Application No. PCT/JP2015/005313.

Mar. 14, 2016, Office Action issued by the Taiwan Intellectual Property Office in the corresponding Taiwanese Patent Application No. 104135317, with English language Search Report.

Jan. 24, 2017, Office Action issued by the Japan Patent Office in the corresponding Japanese Patent Application No. 2016-514793, with English language Concise Statement of relevance.

Jul. 13, 2018, Office Action issued by the Korean Intellectual Property Office in the corresponding Korean Patent Application No. 10-2017-7013435 with English language concise statement of relevance.

Aug. 27, 2018, Communication pursuant to Article 94(3) EPC issued by the European Patent Office in the corresponding European Patent Application No. 15854201.9.

Dec. 4, 2018, Office Action issued by the State Intellectual Property Office in the corresponding Chinese Patent Application No. 201580057710.0 with English language concise statement of relevance.

Jul. 8, 2019, Office Action issued by the China National Intellectual Property Administration in the corresponding Chinese Patent Application No. 201580057710.0 with English language concise statement of relevance.

* cited by examiner

NON-ORIENTED ELECTRICAL STEEL SHEET AND METHOD FOR MANUFACTURING NON-ORIENTED ELECTRICAL STEEL SHEET

TECHNICAL FIELD

This disclosure relates to a non-oriented electrical steel sheet and a method for manufacturing the same.

BACKGROUND

Non-oriented electrical steel sheets are materials used for iron cores of electrical equipment. To increase the efficiency of electrical equipment, it is effective to lower the iron loss of electrical steel sheets. In order to reduce the iron loss, it is effective to add an element having a large specific resistance, such as Si, Al, or Mn. Among these, Al is suitable for achieving both iron loss reduction and blanking workability improvement since it causes a large increase in specific resistance, yet a small increase in strength.

However, Al-added steel has the problem of poor recyclability. Specifically, use of Al-added steel as scrap material causes deterioration of electrodes of the electric furnace, leading to lower recyclability of products.

For better recyclability, it is thus preferable to reduce Al in steel sheets, and there is a demand for electrical steel sheets having excellent magnetic properties even with low Al concentrations.

To address these issues, for example, JP2004277760A (PTL 1) proposes a technique for obtaining excellent magnetic properties by controlling Cu sulfides in low-Al steel.

CITATION LIST

Patent Literature

PTL 1: JP2004277760A

SUMMARY

Technical Problem

In recent years, demands for reducing the iron loss of non-oriented electrical steel sheets are becoming more stringent. To meet the demands for lower iron loss, performance of final annealing at a high temperature of 900° C. or higher is desired. This is because when the final annealing is performed at a high temperature of 900° C. or higher, grains in the steel sheet are coarsened, grain boundaries that inhibit domain wall displacement are reduced, and as a result the iron loss decreases.

In this regard, since the technique of PTL 1 is focused on improving grain growth in final annealing or stress relief annealing performed at a relatively low temperature, sufficient improvement in magnetic properties cannot be expected when final annealing is performed at temperatures as high as 900° C. or higher.

To advantageously solve the above issues, it could be helpful to provide a non-oriented electrical steel sheet that can exhibit excellent magnetic properties and low iron loss properties even when it is formed from low-Al steel on which high-temperature final annealing is performed with a view to lowering iron loss, as well as a method for manufacturing the same.

Solution to Problem

The following provides a description of the circumstances that led to the proposal of the disclosure.

A steel that contains, in mass %, as basic elements, C: 0.003% or less, Si: 1.9%, Mn: 0.5%, Sol. Al: 0.001% or less, P: 0.02% or less, N: 0.005% or less, and O: 0.005% or less, and that further contains, in mass %, Cu: 0.01% to 0.10%, S: 0.0001% to 0.005%, and Se: 0.0001% to 0.002%, was vacuum melted in a laboratory to prepare an ingot. The ingot was subjected to hot rolling and cold rolling to form a steel sheet having a thickness of 0.5 mm, which in turn was subjected to final annealing at a heating rate from 100° C. to 700° C. of 80° C./s in which the steel sheet is retained at 970° C. for 10 s, to thereby obtain a product sheet (non-oriented electrical steel sheet).

The magnetic properties of the product sheet thus obtained are as illustrated in FIGS. 1 and 2. The % representations in the figures are in mass %.

Here, if fine Cu sulfides or Cu selenides are present in the steel sheet microstructure, a pinning effect is caused during a heat treatment such as final annealing. When a pinning effect occurs, growth of secondary recrystallized grains during final annealing is hindered, which impedes reduction of iron loss of the steel sheet.

As illustrated in FIGS. 1 and 2, where the Cu content is below 0.02 mass %, no clear influence is noticeable that is caused by the inclusion of S and Se. The reason for this is considered to be that if fine Cu sulfides or Cu selenides are present in the steel, such Cu sulfides or Cu selenides are dissolved in a solid solution through final annealing performed at high temperature, and no pinning effect occurs.

On the other hand, where the Cu content is 0.02 mass % or more, reducing the content of S and Se brought about a significant iron loss improving effect.

Generally, when the content of Cu is high, the amount of Cu sulfides or Cu selenides produced increases. Thus, even with high-temperature annealing, it is difficult to completely dissolve Cu sulfides or Cu selenides, and fine Cu sulfides and Cu selenides tend to remain in the steel sheet. Such residual fine Cu sulfides or Cu selenides induces a pinning effect, which hinders effective growth of secondary recrystallized grains. This is considered as the cause of increased iron loss of the steel sheet. Accordingly, in this case, the pinning force was decreased by reducing the content of S and Se to eliminate fine Cu sulfides or Cu selenides in the steel, and this might reduce the iron loss. In particular, when the content of S+Se is 0.0010 mass % or less, the resulting iron loss reducing effect is remarkable.

In addition, where the Cu content is 0.02 mass % or more, reducing the content of S and Se improved the magnetic flux density ($B_{50}$). The reason for this is not clear, yet one possible cause is presumed to be that as a result of reduction of the content of S and Se, the amount of S and Se present at grain boundaries was decreased, the sites at which Cu could segregate were increased, and the grain boundary segregation of Cu was promoted, whereby the steel sheet gained an improved recrystallization texture.

We further examined the above findings and completed the disclosure.

Specifically, the primary features of this disclosure are as described below.

(1) A non-oriented electrical steel sheet comprising a chemical composition containing (consisting of), in mass %, C: 0.005% or less, Si: 1.0% to 4.5%, Mn: 0.02% to 2.0%, Sol. Al: 0.001% or less, P: 0.2% or less, S+Se: 0.0010% or less, N: 0.005% or less, O: 0.005% or less, and Cu: 0.02% to 0.30%, and the balance consisting of Fe and incidental impurities.

(2) The non-oriented electrical steel sheet according to (1), wherein the chemical composition further contains either or both of Sn and Sb in a total amount of 0.01 mass % to 0.20 mass %.

(3) The non-oriented electrical steel sheet according to (1) or (2), wherein the chemical composition further contains one or more selected from the group consisting of Ca, REM, and Mg in a total amount of 0.0001 mass % to 0.01 mass %.

(4) A method for manufacturing a non-oriented electrical steel sheet, the method comprising: hot rolling a steel slab to form a hot rolled sheet, the steel slab comprising a chemical composition containing (consisting of), in mass %, C: 0.005% or less, Si: 1.0% to 4.5%, Mn: 0.02% to 2.0%, Sol. Al: 0.001% or less, P: 0.2% or less, S+Se: 0.0010% or less, N: 0.005% or less, O: 0.005% or less, and Cu: 0.02% to 0.30%, and the balance consisting of Fe and incidental impurities; then, optionally, subjecting the hot rolled sheet to hot band annealing; then subjecting the sheet to cold rolling either once, or twice or more with intermediate annealing performed therebetween, so as to have a target thickness; and then subjecting the sheet to final annealing, wherein the final annealing includes a heating process that is performed under a condition of a heating rate from 100° C. to 700° C. of 40° C./s or higher and a final annealing temperature of 900° C. to 1100° C.

(5) The method for manufacturing a non-oriented electrical steel sheet according to (3), wherein the chemical composition further contains either or both of Sn and Sb in a total amount of 0.01 mass % to 0.20 mass %.

(6) The method for manufacturing a non-oriented electrical steel sheet according to (4) or (5), wherein the chemical composition further contains one or more selected from Ca, REM, and Mg in a total amount of 0.0001 mass % to 0.01 mass %.

Advantageous Effect

According to the disclosure, it is possible to obtain a non-oriented electrical steel sheet that can exhibit excellent magnetic properties even when it is formed from a system with reduced Al to which high-temperature annealing is applied.

DETAILED DESCRIPTION

Figure 1:
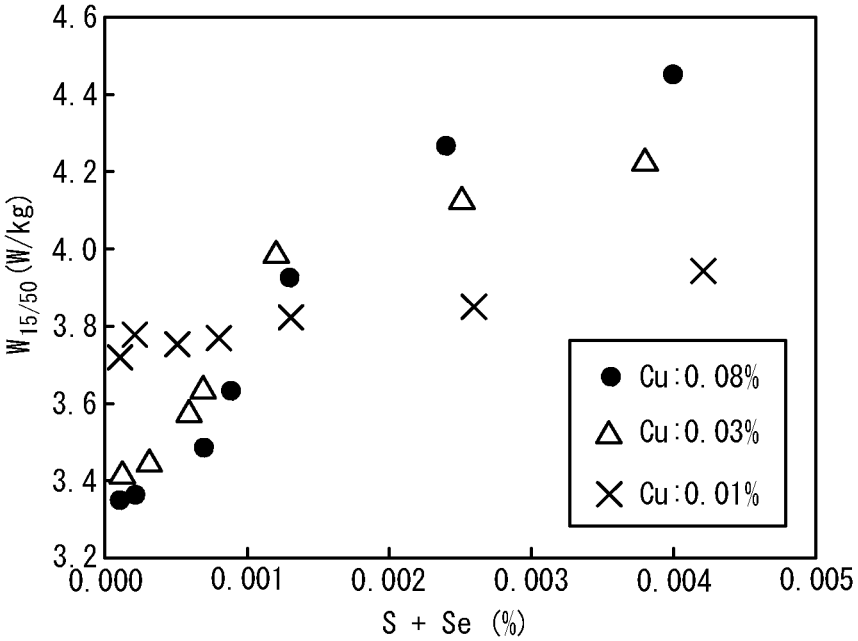
FIG. 1 illustrates the relationship between the content of S and Se and the magnetic property (iron loss) of product sheets.
Figure 2:
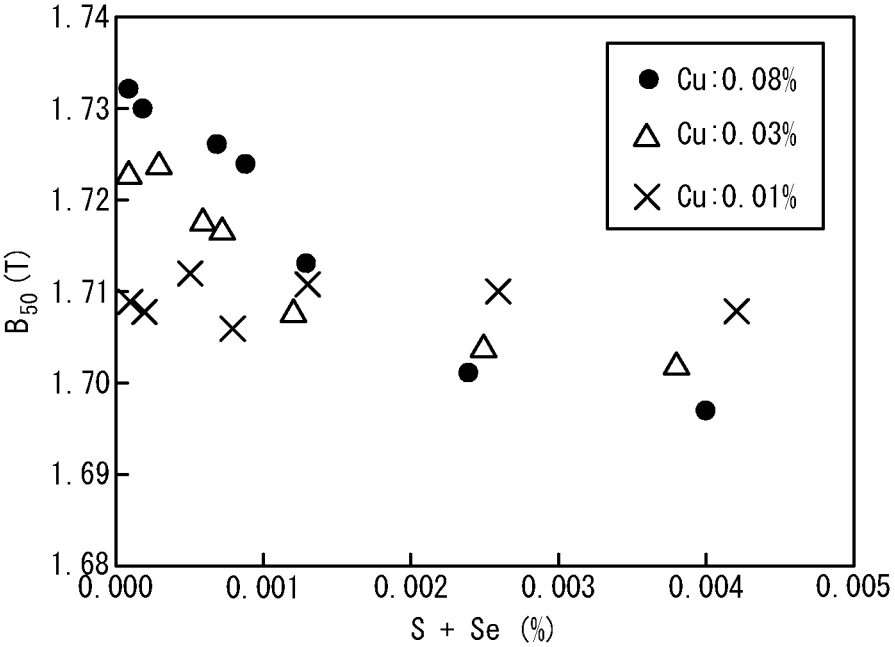
FIG. 2 illustrates the relationship between the content of S and Se and the magnetic property (magnetic flux density) of product sheets.

The present invention will be described in detail hereinafter.

At first, the reasons for the numerical limitations on our steel components are described.

The "%" presentations below indicating the steel components shall stand for "mass %" unless otherwise specified.

C: 0.005% or Less

C precipitates as carbides and causes an increase in iron loss. Thus the C content needs to be reduced as much as possible. From the perspective of suppressing the magnetic aging of the steel sheet, the C content is set to 0.005% or less. No lower limit is placed on the C content, yet from the viewpoint of suppressing the decarburization cost, the C content is preferably 0.0001% or more.

Si: 1.0% to 4.5%

Si is an element that increases the specific resistance of steel. As the Si content increases, the iron loss decreases. To obtain a sufficient iron loss reducing effect, the Si content needs to be 1.0% or more. However, an Si content exceeding 4.5% is problematic as it leads to a decrease in magnetic flux density and an increase in hardness. Therefore, the Si content is set to 1.0% to 4.5%. Considering the balance between iron loss, magnetic flux density, and blanking workability, the Si content is more preferably 1.5% or more. The Si content is more preferably 3.0% or less.

Mn: 0.02% to 2.0%

Mn is an element that suppresses the hot shortness of steel and increases the specific resistance of steel. To obtain this effect, the Mn content needs to be 0.02% or more. However, if the Mn content exceeds 2.0%, carbides precipitate and the iron loss ends up increasing instead. Therefore, the Mn content is set to 0.02% to 2.0%. The Mn content is preferably 0.15% or more. The Mn content is preferably 0.8% or less.

Sol. Al: 0.001% or Less

Sol. Al (acid-soluble Al) forms fine AlN and causes an increase in iron loss. Therefore, the Sol. Al content needs to be 0.001% or less. The Sol. Al content is more preferably 0.0005% or less. No lower limit is placed on the Sol. Al content, yet an industrially preferred Sol. Al content is approximately 0.00001%.

P: 0.2% or Less

P is an element that increases the hardness of steel and that can be used for adjusting the hardness of products. However, if P is excessively added beyond 0.2%, the steel becomes brittle, and cracking tends to occur in cold rolling. Therefore, the P content is limited to 0.2% or less. The P content is more preferably 0.1% or less. No lower limit is placed on the P content, yet an industrially preferred P content is approximately 0.0001%.

S+Se: 0.0010% or Less

S and Se are elements that form fine sulfides and selenides and cause an increase in iron loss. Since Cu is added to the disclosed steel, its influence is particularly significant. In order to reduce iron loss, the content of S+Se needs be reduced to 0.0010% or less. The content of S+Se is more preferably 0.0005% or less. By controlling the content of S and Se within this range, it is also possible to efficiently bring out a magnetic flux density improving effect by adding Cu.

The S content and the Se content are preferably reduced to 0.0005% or less and 0.0001% or less, respectively. No lower limit is placed on the content of S+Se, yet an industrially preferred content is approximately 0.00001%.

N: 0.005% or Less

N forms fine nitrides and causes an increase in iron loss. Therefore, the N content needs to be 0.005% or less. The N content is more preferably 0.003% or less. No lower limit is placed on the N content, yet an industrially preferred N content is approximately 0.0001%.

O: 0.005% or Less

O increases oxides and causes an increase in iron loss. Therefore, the O content needs to be 0.005% or less. The O content is more preferably 0.003% or less. No lower limit is placed on the O content, yet an industrially preferred O content is approximately 0.0001%.

Cu: 0.02% to 0.30%

Cu is one of tramp elements whose content increases as recycling of iron proceeds. The present disclosure positively utilizes this Cu. Cu produces fine sulfides and selenides and causes an increase in iron loss, yet, on the contrary, it also has the effect of improving recrystallization textures and reducing iron loss. To obtain the iron loss reducing effect, the Cu content needs to be 0.02% or more. However, adding Cu beyond 0.30% causes surface defects. Therefore, the Cu content is set to 0.02% to 0.30%. The Cu content is more preferably 0.05% or more. The Cu content is more preferably 0.10% or less.

Either or Both of Sn and Sb: 0.01% to 0.20% in Total

Sn and Sb have the effect of improving the recrystallization texture and the magnetic flux density of steel.

However, if the total content of one or two elements selected from Sn and Sb is below 0.01%, the addition effect is limited. On the other hand, if the content exceeds 0.20%, the addition effect reaches a plateau. Therefore, the total content of one or two elements selected from Sn and Sb is preferably 0.01% or more. The total content is preferably 0.20% or less.

One or more selected from the group consisting of Ca, REM, and Mg: 0.0001% to 0.01% in total Ca, REM, and Mg are elements that form stable sulfides and selenides, and by adding one or more of these elements to the disclosed steel, even better iron loss properties can be obtained.

However, if the content of one or more selected from the group consisting of Ca, REM and Mg is below 0.0001%, the addition effect is limited. On the other hand, if the content exceeds 0.01%, the iron loss increases instead. Therefore, the total content of one or more selected from the group consisting of Ca, REM, and Mg is preferably 0.0001% or more. The total content is preferably 0.01% or less.

In the disclosure, it is desirable to minimize the amount of fine Cu sulfides and Cu selenides. That is, the number density of Cu sulfides and Cu selenides having a diameter of 10 nm to 200 nm is preferably 10/$\mu m^2$ or lower in total.

In the disclosure, the number density of fine Cu sulfides and Cu selenides is determined by electrolysis of a central layer in the thickness direction of a sample, observation of the replica under a TEM (transmission electron microscope), and analysis of precipitates with EDX (energy-dispersive X-ray spectroscopy). In the disclosure, the calculation of the number density of the precipitates was conducted assuming that the total charge used in the electrolytic process in the replica production process was consumed to convert Fe to $Fe^{2+}$ and that all the residues (precipitates) obtained in the electrolytic process were captured by the replica.

Those precipitates having a diameter of 200 nm or more do not exert a significant influence on the magnetic properties, and may thus be excluded from the measurement. Additionally, precipitates having a diameter of 10 nm or less may also be excluded from the measurement, since they are difficult to analyze with EDX and are so small in number within the range specified in the disclosure that only a minor influence is exerted on the magnetic properties.

The following provides a description of a manufacturing method according to the disclosure. Note that conditions of manufacturing non-oriented electrical steel sheets and the like other than those specified below may be determined by known methods for manufacturing non-oriented electrical steel sheets.

A slab may be produced from a molten steel adjusted to the above-described preferred chemical composition using a usual ingot casting and blooming method or a continuous casting method. Alternatively, a thin slab or thinner cast steel with a thickness of 100 mm or less may be produced using a direct casting method. Then, the slab is heated in a usual way and hot rolled to obtain a hot rolled sheet. At this point, the slab may be immediately subjected to hot rolling without being heated after casting. After the hot rolling, the hot rolled sheet is further subjected to a heat treatment (hot band annealing) in which the hot rolled sheet is retained in a temperature range of 700° C. to 900° C. for 10 minutes to 10 hours, or in a temperature range of 900° C. to 1100° C. for 1 second to 5 minutes, which may achieve a further improvement in the magnetic properties. In the disclosure, such heat treatment may be omitted from the viewpoint of cost reduction.

Thereafter, the hot rolled sheet is subjected to pickling, then to cold rolling either once, or twice or more with intermediate annealing performed therebetween, so as to have a final sheet thickness, and to subsequent final annealing to form a steel sheet. From the perspective of iron loss reduction, final annealing is performed at a high temperature of 900° C. or higher. This is because when the final annealing is performed at 900° C. or higher, grains are coarsened and grain boundaries that inhibit domain wall displacement are reduced, which fact is advantageous for reducing iron loss. However, an annealing temperature exceeding 1100° C. leads to problems such as metal pickup. Therefore, the final annealing temperature is set in a range of 900° C. to 1100° C.

In the disclosure, it is also possible to obtain a good iron loss reducing effect by setting the heating rate from 100° C. to 700° C. during a heating process in the final annealing to 40° C./s or higher.

The reason for this is not clear, yet one possible cause is considered as follows.

When the heating rate in the above-described temperature range during a heating process in the final annealing is low, recrystallization of {111} oriented grains preferentially proceeds in the steel and crystals with {100} and {110} orientations are reduced accordingly, which are favorable in the context of the disclosure as being advantageous for improving magnetic properties. This tendency is particularly conspicuous under the condition that {111} oriented grains in the steel become predominant, for example, when hot band annealing is not performed or when the cold rolling reduction is large. The heating rate from 100° C. to 700° C. is preferably 100° C./s or higher.

No upper limit is placed on the heating rate, yet from the perspective of suppressing investment in heating equipment such as IH and electrical heating, the heating rate is preferably 500° C./s or lower.

After the final annealing, an insulating coating is optionally applied to the steel sheet to obtain a non-oriented electrical steel sheet as a product sheet. In the disclosure, known insulating coatings may be used. For example, inorganic coatings, organic coatings, inorganic-organic mixed coatings, and the like can be selectively used according to the purpose.

EXAMPLES

Steel slabs having the chemical compositions listed in Table 1 were heated at 1120° C. for 20 minutes, and hot rolled to form hot rolled sheets. Then, some of the hot rolled sheets were subjected to hot band annealing and subsequently to cold rolling, while the others were directly subjected to cold rolling without being subjected to hot band annealing, to thereby form cold rolled sheets having a thickness of 0.35 mm. These cold rolled sheets were subjected to final annealing under the conditions of a temperature of 950° C. and a holding time of 10 seconds, in an atmosphere with a dew point of −40° C. where $H_2$:$N_2$=20:80

(a ratio in vol %). Then, insulating coating treatment was carried out to prepare product sheets.

The hot band annealing conditions and the heating rate from 100° C. to 700° C. during the heating process in the final annealing are listed in Table 1. In addition, test pieces of 280 mm×30 mm were collected from the product sheets and subjected to magnetometry in accordance with the Epstein test method prescribed in HS C 2550-1:2011.

The magnetometry results are also listed in Table 1. Moreover, the diameters of Cu sulfides and Cu selenides were measured with the above-described method, and the number densities are listed in Table 1. In the table, the number density of Cu sulfides is the number density per $\mu m^2$ of Cu sulfides having a diameter of 10 nm to 200 nm, and the number density of Cu selenides is the number density per $\mu m^2$ of Cu selenides having a diameter of 10 nm to 200 nm.

TABLE 1

| | Steel sheet composition (mass %) | | | | | | | | | | | |
|---|---|---|---|---|---|---|---|---|---|---|---|---|
| No. | C | Si | Mn | Sol. Al | P | N | O | Cu | S | Se | S + Se | Others |
| 1 | 0.0020 | 1.83 | 0.43 | 0.0005 | 0.08 | 0.0018 | 0.0028 | 0.06 | 0.0005 | 0.0002 | 0.0007 | — |
| 2 | 0.0020 | 1.83 | 0.43 | 0.0005 | 0.08 | 0.0018 | 0.0028 | 0.06 | 0.0005 | 0.0002 | 0.0007 | — |
| 3 | 0.0020 | 1.83 | 0.43 | 0.0005 | 0.08 | 0.0018 | 0.0028 | 0.06 | 0.0005 | 0.0002 | 0.0007 | — |
| 4 | 0.0018 | 1.86 | 0.36 | 0.0002 | 0.06 | 0.0021 | 0.0029 | 0.01 | 0.0004 | 0.0001 | 0.0005 | — |
| 5 | 0.0016 | 1.91 | 0.46 | 0.0004 | 0.05 | 0.0013 | 0.0016 | 0.06 | 0.0015 | 0.0002 | 0.0017 | — |
| 6 | 0.0019 | 1.88 | 0.42 | 0.0008 | 0.07 | 0.0016 | 0.0019 | 0.05 | 0.0005 | 0.0009 | 0.0014 | — |
| 7 | 0.0023 | 2.04 | 0.46 | 0.0015 | 0.02 | 0.0014 | 0.0022 | 0.06 | 0.0003 | 0.0002 | 0.0005 | — |
| 8 | 0.0014 | 1.92 | 0.39 | 0.0002 | 0.05 | 0.0055 | 0.0025 | 0.05 | 0.0004 | 0.0001 | 0.0005 | — |
| 9 | 0.0008 | 1.83 | 0.35 | 0.0005 | 0.06 | 0.0023 | 0.0062 | 0.06 | 0.0003 | 0.0002 | 0.0005 | — |
| 10 | 0.0021 | 1.88 | 0.51 | 0.0001 | 0.06 | 0.0017 | 0.0026 | 0.06 | 0.0003 | 0.0001 | 0.0004 | Sb: 0.07 |
| 11 | 0.0008 | 1.93 | 0.39 | 0.0003 | 0.05 | 0.0023 | 0.0018 | 0.05 | 0.0002 | 0.0002 | 0.0004 | Sn: 0.04 |
| 12 | 0.0011 | 1.92 | 0.42 | 0.0003 | 0.04 | 0.0021 | 0.0014 | 0.05 | 0.0002 | 0.0001 | 0.0003 | Ca: 0.0034 |
| 13 | 0.0013 | 1.94 | 0.42 | 0.0002 | 0.04 | 0.0015 | 0.0013 | 0.04 | 0.0004 | 0.0001 | 0.0005 | Mg: 0.0005 |
| 14 | 0.0014 | 1.89 | 0.45 | 0.0002 | 0.03 | 0.0018 | 0.0015 | 0.03 | 0.0003 | 0.0001 | 0.0004 | REM: 0.0024 |
| 15 | 0.0018 | 1.75 | 0.56 | 0.0003 | 0.07 | 0.0016 | 0.0013 | 0.05 | 0.0004 | 0.0001 | 0.0005 | — |
| 16 | 0.0018 | 1.75 | 0.56 | 0.0003 | 0.07 | 0.0016 | 0.0013 | 0.05 | 0.0004 | 0.0001 | 0.0005 | — |
| 17 | 0.0018 | 1.75 | 0.56 | 0.0003 | 0.07 | 0.0016 | 0.0013 | 0.05 | 0.0004 | 0.0001 | 0.0005 | — |
| 18 | 0.0009 | 1.63 | 0.49 | 0.0003 | 0.06 | 0.0009 | 0.0021 | 0.01 | 0.0003 | 0.0002 | 0.0005 | — |
| 19 | 0.0026 | 1.68 | 0.45 | 0.0002 | 0.06 | 0.0028 | 0.0024 | 0.05 | 0.0016 | 0.0001 | 0.0017 | — |
| 20 | 0.0021 | 1.72 | 0.53 | 0.0001 | 0.07 | 0.0019 | 0.0023 | 0.06 | 0.0005 | 0.0007 | 0.0012 | — |
| 21 | 0.0014 | 1.61 | 0.61 | 0.0018 | 0.04 | 0.0018 | 0.002 | 0.07 | 0.0002 | 0.0001 | 0.0003 | — |
| 22 | 0.0016 | 1.63 | 0.49 | 0.0002 | 0.06 | 0.0059 | 0.0012 | 0.06 | 0.0006 | 0.0001 | 0.0007 | — |
| 23 | 0.0027 | 1.64 | 0.56 | 0.0004 | 0.06 | 0.0021 | 0.0058 | 0.07 | 0.0003 | 0.0002 | 0.0005 | — |
| 24 | 0.0018 | 1.62 | 0.55 | 0.0001 | 0.07 | 0.0013 | 0.0029 | 0.06 | 0.0002 | 0.0001 | 0.0003 | Sb: 0.02 |
| 25 | 0.0014 | 1.69 | 0.52 | 0.0004 | 0.06 | 0.0022 | 0.0019 | 0.06 | 0.0002 | 0.0004 | 0.0006 | Sn: 0.12 |
| 26 | 0.0013 | 1.52 | 0.49 | 0.0002 | 0.02 | 0.0011 | 0.0014 | 0.05 | 0.0002 | 0.0002 | 0.0004 | Ca: 0.0045 |
| 27 | 0.0012 | 1.63 | 0.48 | 0.0006 | 0.05 | 0.0013 | 0.0016 | 0.05 | 0.0003 | 0.0002 | 0.0005 | Mg: 0.0008 |
| 28 | 0.0015 | 1.58 | 0.49 | 0.0003 | 0.06 | 0.0018 | 0.0012 | 0.06 | 0.0002 | 0.0001 | 0.0003 | REM: 0.0018 |

| | Hot band annealing | | Final annealing | Heating rate from 100° C. to 700° C. | Number density of Cu | Number density of Cu | | | |
|---|---|---|---|---|---|---|---|---|---|
| No. | Temp. (° C.) | Time | temp. (° C.) | in final annealing (° C./s) | sulfides (counts/$\mu m^2$) | selenides (counts/$\mu m^2$) | $W_{15/50}$ (W/kg) | $B_{50}$ (T) | Remarks |
| 1 | 1000 | 30 | 950 | 100 | 3 | 3 | 2.431 | 1.728 | Example |
| 2 | 1000 | 30 | 950 | 40 | 3 | 3 | 2.463 | 1.725 | Example |
| 3 | 1000 | 30 | 950 | 20 | 3 | 3 | 2.543 | 1.716 | Example |
| 4 | 980 | 30 | 950 | 100 | 2 | 1 | 2.642 | 1.708 | Comparative Example |
| 5 | 995 | 30 | 950 | 100 | 11 | 2 | 2.678 | 1.709 | Comparative Example |
| 6 | 1010 | 30 | 950 | 100 | 2 | 11 | 2.789 | 1.703 | Comparative Example |
| 7 | 1000 | 30 | 950 | 100 | 2 | 3 | 2.623 | 1.707 | Comparative Example |
| 8 | 990 | 30 | 950 | 100 | 2 | 2 | 2.673 | 1.702 | Comparative Example |
| 9 | 1000 | 30 | 950 | 100 | 2 | 2 | 2.614 | 1.708 | Comparative Example |
| 10 | 1000 | 10 | 950 | 100 | 2 | 1 | 2.413 | 1.735 | Example |
| 11 | 990 | 10 | 950 | 100 | 1 | 3 | 2.409 | 1.742 | Example |
| 12 | 1000 | 15 | 950 | 200 | 1 | 1 | 2.326 | 1.737 | Example |
| 13 | 1000 | 30 | 950 | 200 | 1 | 1 | 2.351 | 1.738 | Example |
| 14 | 970 | 5 | 950 | 200 | 1 | 1 | 2.376 | 1.736 | Example |
| 15 | N/A | N/A | 950 | 100 | 2 | 1 | 2.514 | 1.726 | Example |
| 16 | N/A | N/A | 950 | 40 | 2 | 1 | 2.543 | 1.721 | Example |
| 17 | N/A | N/A | 950 | 20 | 2 | 1 | 2.599 | 1.711 | Example |
| 18 | N/A | N/A | 950 | 100 | 2 | 2 | 2.764 | 1.673 | Comparative Example |
| 19 | N/A | N/A | 950 | 100 | 12 | 1 | 2.836 | 1.678 | Comparative Example |
| 20 | N/A | N/A | 950 | 100 | 2 | 11 | 2.864 | 1.675 | Comparative Example |
| 21 | N/A | N/A | 950 | 100 | 1 | 1 | 2.799 | 1.669 | Comparative Example |
| 22 | N/A | N/A | 950 | 100 | 4 | 2 | 2.823 | 1.665 | Comparative Example |
| 23 | N/A | N/A | 950 | 100 | 3 | 2 | 2.845 | 1.668 | Comparative Example |
| 24 | N/A | N/A | 950 | 100 | 2 | 1 | 2.456 | 1.732 | Example |
| 25 | N/A | N/A | 950 | 100 | 2 | 3 | 2.465 | 1.736 | Example |
| 26 | N/A | N/A | 950 | 200 | 1 | 1 | 2.421 | 1.731 | Example |
| 27 | N/A | N/A | 950 | 200 | 1 | 1 | 2.418 | 1.729 | Example |
| 28 | N/A | N/A | 950 | 200 | 1 | 1 | 2.425 | 1.732 | Example |

As can be seen from Table 1, those product sheets satisfying the requirements of the disclosure provided non-oriented electrical steel sheets that exhibited excellent magnetic properties, despite each being formed from a system with reduced Al to which high-temperature annealing had been applied.

The invention claimed is:

1. A method for manufacturing a non-oriented electrical steel sheet, the method comprising:

hot rolling a steel slab to form a hot rolled sheet, the steel slab comprising a chemical composition containing, in mass %, C: 0.005% or less, Si: more than 1.5% and 4.5% or less, Mn: 0.02% to 2.0%, Sol. Al: 0.001% or less, P: 0.2% or less, S+Se: more than 0% and 0.0010% or less wherein both S and Se are present in an amount greater than 0%, N: 0.005% or less, O: 0.005% or less, and Cu: 0.03% to 0.08%, and the balance consisting of Fe and incidental impurities, and a number density of Cu sulfides and Cu selenides having a diameter of 10 nm to 200 nm is $10/\mu m^2$ or lower in total; wherein both Cu sulfides and Cu selenides are present in an amount greater than $0/\mu m^2$;

then, optionally, subjecting the hot rolled sheet to hot band annealing;

then subjecting the sheet to cold rolling either once, or twice or more with intermediate annealing performed therebetween, so as to have a target thickness; and then subjecting the sheet to final annealing, wherein the final annealing includes a heating process that is performed under a condition of a heating rate from 100° C. to 700° C. of 40° C./s or higher and a final annealing temperature of 900° C. to 1100° C.

2. The method for manufacturing a non-oriented electrical steel sheet according to claim 1, wherein the chemical composition further contains either or both of Sn and Sb in a total amount of 0.01 mass % to 0.20 mass %.

3. The method for manufacturing a non-oriented electrical steel sheet according to claim 2, wherein the chemical composition further contains one or more selected from Ca, REM, and Mg in a total amount of 0.0001 mass % to 0.01 mass %.

4. The method for manufacturing a non-oriented electrical steel sheet according to claim 1, wherein the chemical composition further contains one or more selected from Ca, REM, and Mg in a total amount of 0.0001 mass % to 0.01 mass %.

* * * * *